US011326420B2

(12) United States Patent
Cho et al.

(10) Patent No.: US 11,326,420 B2
(45) Date of Patent: May 10, 2022

(54) GRAVEL PACK FLOW CONTROL USING SWELLABLE METALLIC MATERIAL

(71) Applicant: Halliburton Energy Services, Inc., Houston, TX (US)

(72) Inventors: Brian Williams Cho, Katy, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/066,262

(22) Filed: Oct. 8, 2020

(65) Prior Publication Data

US 2022/0112790 A1 Apr. 14, 2022

(51) Int. Cl.

| | |
|---|---|
| ***E21B 43/04*** | (2006.01) |
| ***E21B 43/08*** | (2006.01) |
| ***E21B 43/12*** | (2006.01) |

(52) U.S. Cl.

CPC ..... *E21B 43/04* (2013.01); *E21B 43/088* (2013.01); *E21B 43/12* (2013.01)

(58) Field of Classification Search

CPC ..... E21B 43/04; E21B 43/12; E21B 43/088
See application file for complete search history.

(56) References Cited

U.S. PATENT DOCUMENTS 6,622,794 B2 * 9/2003 Zisk, Jr. ..... E21B 34/066 166/373
7,637,320 B2 * 12/2009 Howard ..... B01D 39/1646 166/295
7,708,068 B2 * 5/2010 Hailey, Jr. ..... E21B 34/08 166/278
7,828,067 B2 5/2010 Hailey
8,657,016 B2 2/2014 Greci et al.
8,789,597 B2 * 7/2014 Al-Shammari ..... E21B 17/00 166/292
8,936,094 B2 1/2015 Least et al.
8,960,316 B2 2/2015 Greci
9,038,741 B2 5/2015 Lopez et al.
9,091,147 B2 7/2015 Greci
9,353,605 B2 5/2016 Hailey, Jr. et al.
(Continued)

FOREIGN PATENT DOCUMENTS

| | | |
|---|---|---|
| CN | 107143315 | 9/2017 |
| WO | 2016-081287 | 5/2016 |
| WO | 2019164499 | 8/2019 |

OTHER PUBLICATIONS

International Search Report and Written Opinion for Application No. PCT/UW2020/056745, dated Jul. 1, 2021.

*Primary Examiner* — Michael R Wills, III
(74) *Attorney, Agent, or Firm* — Scott Richardson; C. Tumey Law Group PLLC

(57) ABSTRACT

A gravel pack flow path used to flow slurry fluids during a gravel pack phase may be closed or at least limited with a swellable metallic material prior to a production phase. An example apparatus may include a base pipe, a screen disposed about the base pipe, an inflow control device having an ICD flow path in fluid communication with an outer annulus between the screen and base pipe. The gravel pack flow path defined in part by perforations in a base pipe or by a secondary housing. A swellable metallic material is activated to close the gravel pack flow path in response to a reactive fluid.

20 Claims, 6 Drawing Sheets

(56) References Cited

U.S. PATENT DOCUMENTS

| | | | | |
|---|---|---|---|---|
| 9,546,537 | B2 | 1/2017 | Greci et al. | |
| 9,587,468 | B2 | 3/2017 | Greci et al. | |
| 9,631,461 | B2 | 4/2017 | Lopez et al. | |
| 9,725,984 | B2 | 8/2017 | Fripp et al. | |
| 9,765,617 | B2 | 9/2017 | Gosney et al. | |
| 9,828,838 | B2 | 11/2017 | Lopez et al. | |
| 10,024,116 | B2 | 7/2018 | Veit et al. | |
| 10,101,714 | B2 | 10/2018 | Lopez et al. | |
| 10,101,715 | B2 | 10/2018 | Lopez et al. | |
| 10,208,571 | B2 | 2/2019 | Yin et al. | |
| 10,287,850 | B2 | 5/2019 | Fripp et al. | |
| 10,294,762 | B2 | 5/2019 | Greci et al. | |
| 10,358,893 | B2 | 7/2019 | Greci | |
| 10,364,656 | B2 | 7/2019 | Greci | |
| 10,502,032 | B2 | 12/2019 | Greci et al. | |
| 10,619,435 | B2 | 4/2020 | Greci et al. | |
| 11,047,203 | B2 | 6/2021 | Fripp et al. | |
| 2007/0246213 | A1 | 10/2007 | Hailey, Jr. | |
| 2010/0200233 | A1* | 8/2010 | Yeh | E21B 43/082 166/276 |
| 2013/0161024 | A1 | 6/2013 | Greci | |
| 2013/0213667 | A1 | 8/2013 | Lopez et al. | |
| 2013/0220632 | A1 | 8/2013 | Greci et al. | |
| 2013/0264072 | A1 | 10/2013 | Lopez et al. | |
| 2014/0014337 | A1 | 1/2014 | Stringfield et al. | |
| 2014/0246206 | A1 | 9/2014 | Least et al. | |
| 2014/0262324 | A1 | 9/2014 | Greci et al. | |
| 2014/0332229 | A1 | 11/2014 | Greci | |
| 2015/0027700 | A1 | 1/2015 | Riisem et al. | |
| 2015/0376983 | A1 | 12/2015 | Greci | |
| 2016/0137912 | A1* | 5/2016 | Sherman | C09K 8/706 166/280.2 |
| 2016/0139616 | A1* | 5/2016 | Mellah | E21B 43/2406 236/101 R |
| 2016/0251908 | A1 | 9/2016 | Jan et al. | |
| 2016/0251936 | A1 | 9/2016 | Fripp et al. | |
| 2016/0265318 | A1 | 9/2016 | Greci et al. | |
| 2016/0273320 | A1 | 9/2016 | Greci et al. | |
| 2016/0273355 | A1 | 9/2016 | Gosney et al. | |
| 2019/0040714 | A1 | 2/2019 | Fripp et al. | |
| 2020/0063518 | A1 | 2/2020 | Fripp et al. | |
| 2020/0064871 | A1 | 2/2020 | Fripp et al. | |
| 2020/0263520 | A1 | 8/2020 | Frosell et al. | |

* cited by examiner

GRAVEL PACK FLOW CONTROL USING SWELLABLE METALLIC MATERIAL

BACKGROUND

Wells are often constructed for the potential recovery of hydrocarbons such as oil and gas. A wellbore may first be drilled to the desired depth into a formation. A wellbore is typically reinforced with a casing string cemented in place downhole and perforated at selected intervals for extracting hydrocarbon fluids from the formation. A production zone may also be sealed off and stimulated with well treatments intended to enhance production. A production tubing string may be run into the well to the production zone, protecting the casing and providing a flow path to a wellhead through which the oil and gas can be produced. Sand screens may also be installed in selected production zones to filter certain particulates while permitting liquid flow. Many wells are benefited by additionally having a gravel pack placed around the screens.

An inflow control device (ICD) may also be installed when the well is constructed, to control the flow of produced fluids. An ICD may variably restrict the fluid flow, to preferentially produce certain formation fluids like oil while restricting other fluids like water. ICDs may have the capability to respond to changed downhole conditions and/or be remotely controlled (e.g., "intelligent" inflow control devices). Very long horizontal open hole completions can benefit substantially from the use of inflow control devices in screens. However, ICDs are conventionally not conducive to the gravel packing process due to their inherent flow restrictions.

BRIEF DESCRIPTION OF THE DRAWINGS

These drawings illustrate certain aspects of some of the embodiments of the present disclosure and should not be used to limit or define the method to just the illustrated embodiments.

DETAILED DESCRIPTION

Figure 1:
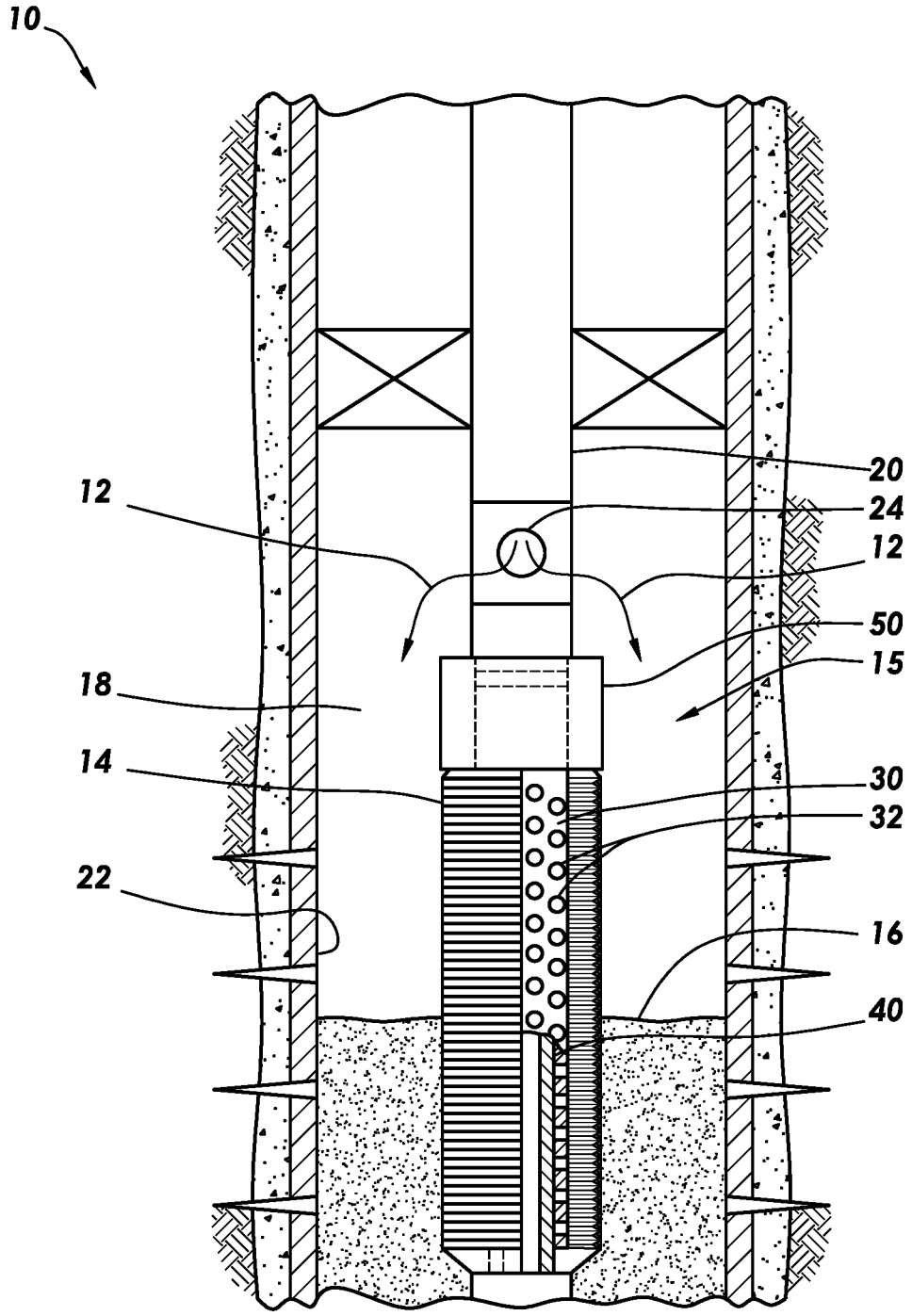
FIG. 1 is an elevation view of an example well system 10 for gravel packing an inflow control device according to aspects of the present disclosure.

The present disclosure is direct to various apparatus and methods for gravel packing around a flow-restrictive component that may sufficiently restrict flow through the flow-restrictive component to otherwise limit how well the gravel packing could be performed. Examples are provided in the context of an inflow control device (ICD) used to control the production of formation fluids as described below, although aspects of this disclosure are not necessarily limited to use with ICDs. The apparatus and methods may use a swellable metallic material to selectively close or at least restrict flow through a flow path after gravel packing has been performed. The disclosed assemblies and methods enable a high-quality gravel packing even in proximity to an ICD. The gravel pack may be performed in cases where the ICD alone would not ordinarily provide a sufficient flow rate for slurry pumping techniques used in a conventional gravel packing operation.

In one aspect, a gravel pack flow path (i.e., GP flow path) is provided to supplement or provide all the flow rate needed for the gravel packing phase. The GP flow path may also improve directional flow to allow for uniform hydration of the gravel slurry during the gravel pack phase to ensure uniform, high-quality gravel packing around the screen. The GP flow path is subsequently closed by activation of swellable metallic material, so that formation fluids are then directed through the ICD following the gravel pack phase.

Embodiments generally include a screen positioned around an ICD base pipe, defining an outer annulus between the sand screen and base pipe, and a wash pipe removably disposed inside the ICD base pipe, defining an inner annulus between the base pipe and wash pipe. In some example embodiments, the base pipe is perforated, and the GP flow path comprises perforations along the base pipe leading to the inner annulus, and along the inner annulus to the wash pipe. In other example embodiments, the base pipe is non-perforated, and the GP flow path instead comprises the outer annulus and a secondary housing at one end of the base pipe in fluid communication with the outer annulus. In any of the foregoing embodiments, the GP flow path may be closed by activation of the swellable metallic material following the gravel pack phase so that formation fluids are routed through the ICD during production. The GP flow path may be closed anywhere along the GP flow path, without necessarily plugging the entire GP flow path. For example, depending on the embodiment, plugging all or most of the perforations in the perforated base pipe, or closing off the portion of an ICD flow path that extends through a secondary housing, may suffice.

Examples of Swellable Metallic Materials

Not every material that expands in the presence of fluid is suitable for use with the present disclosure. To be effective, an expandable material must be able to limit flow and preferably substantially close flow paths such as perforations used during a gravel pack phase, even in the presence of elevated downhole fluid temperatures and pressures. Examples of the methods and systems described herein therefore specifically involve the use of certain swellable metallic materials that have the capability of effectively plugging flow paths to divert fluids to another flow path. The swellable metallic materials may be placed in proximity to a selected flow path and then activated by a fluid to cause, induce, or otherwise participate in the reaction that causes the material to close the flow path. In one example, the swellable metallic materials may react in brines to close the flow path. To close the flow path, the swellable metallic material may increase its volume, become displaced, solidify, thicken, harden, or a combination thereof. Some swellable metallic materials may thicken or harden in response to physical constraints imposed by the flow path, versus in an unbounded volume (e.g. an open lab beaker) in which the thickening or hardening may not otherwise occur. The swellable metallic materials may swell in high-salinity and/or high-temperature environments where elastomeric materials, such as rubber, can perform poorly. The swellable metallic materials comprise a wide variety of metals and metal alloys and may swell by the formation of metal hydroxides. The swellable metallic materials swell by undergoing metal hydration reactions in the presence of brines to form metal hydroxides.

In one or more embodiments, the metal hydroxide occupies more space than the base metal reactant. This expansion in volume allows the swellable metallic material to form a seal at the interface of the swellable metallic material and any adjacent surfaces. For example, a mole of magnesium has a molar mass of 24 g/mol and a density of 1.74 g/cm3 which results in a volume of 13.8 cm/mol. Magnesium hydroxide has a molar mass of 60 g/mol and a density of 2.34 g/cm3 which results in a volume of 25.6 cm/mol. 25.6 cm/mol is 85% more volume than 13.8 cm/mol. As another example, a mole of calcium has a molar mass of 40 g/mol and a density of 1.54 g/cm3 which results in a volume of 26.0 cm/mol. Calcium hydroxide has a molar mass of 76 g/mol and a density of 2.21 g/cm3 which results in a volume of 34.4 cm/mol. 34.4 cm/mol is 32% more volume than 26.0 cm/mol. As yet another example, a mole of aluminum has a molar mass of 27 g/mol and a density of 2.7 g/cm3 which results in a volume of 10.0 cm/mol. Aluminum hydroxide has a molar mass of 63 g/mol and a density of 2.42 g/cm3 which results in a volume of 26 cm/mol. 26 cm/mol is 160% more volume than 10 cm/mol. The swellable metallic material comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metallic material.

Examples of suitable metals for the swellable metallic material include, but are not limited to, magnesium, calcium, aluminum, tin, zinc, beryllium, barium, manganese, or any combination thereof. Preferred metals include magnesium, calcium, and aluminum. Examples of suitable metal alloys for the swellable metallic material include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these nonmetallic elements include, but are not limited to, graphite, carbon, silicon, boron nitride, and the like. In some examples, the metal is alloyed to increase reactivity and/or to control the formation of oxides. In some examples, the metal alloy is also alloyed with a dopant metal that promotes corrosion or inhibits passivation and thus increased hydroxide formation. Examples of dopant metals include, but are not limited to nickel, iron, copper, carbon, titanium, gallium, mercury, cobalt, iridium, gold, palladium, or any combination thereof. In examples where the swellable metallic material comprises a metal alloy, the metal alloy may be produced from a solid solution process or a powder metallurgical process. The sealing element comprising the metal alloy may be formed either from the metal alloy production process or through subsequent processing of the metal alloy. As used herein, the term "solid solution" may include an alloy that is formed from a single melt where all of the components in the alloy (e.g., a magnesium alloy) are melted together in a casting. The casting can be subsequently extruded, wrought, hipped, or worked to form the desired shape for the sealing element of the swellable metallic material. Preferably, the alloying components are uniformly distributed throughout the metal alloy, although intragranular inclusions may be present, without departing from the scope of the present disclosure.

It is to be understood that some minor variations in the distribution of the alloying particles can occur, but it is preferred that the distribution is such that a homogenous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase. A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metallic material.

In some alternative examples, the swellable metallic material comprises an oxide. As an example, calcium oxide reacts with water in an energetic reaction to produce calcium hydroxide. 1 mole of calcium oxide occupies 9.5 $cm^3$ whereas 1 mole of calcium hydroxide occupies 34.4 $cm^3$ which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

A swellable metallic material may be selected that does not degrade into the brine. As such, the use of metals or metal alloys for the swellable metallic material that form relatively water-insoluble hydration products may be preferred. For example, magnesium hydroxide and calcium hydroxide have low solubility in water. In some examples, the metal hydration reaction may comprise an intermediate step where the metal hydroxides are small particles. When confined, these small particles may lock together. Thus, there may be an intermediate step where the swellable metallic material forms a series of fine particles between the steps of being solid metal and forming a seal. The small particles have a maximum dimension less than 0.1 inch and generally have a maximum dimension less than 0.01 inches. In some embodiments, the small particles comprise between one and 100 grains (metallurgical grains).

In some alternative examples, the swellable metallic material is dispersed into a binder material. The binder may be degradable or non-degradable. In some examples, the binder may be hydrolytically degradable. The binder may be swellable or non-swellable. If the binder is swellable, the binder may be oil-swellable, water-swellable, or oil- and water-swellable. In some examples, the binder may be porous. In some alternative examples, the binder may not be porous. General examples of the binder include, but are not limited to, rubbers, plastics, and elastomers. Specific examples of the binder may include, but are not limited to, polyvinyl alcohol, polylactic acid, polyurethane, polyglycobc acid, nitrile rubber, isoprene rubber, PTFE, silicone, fluroelastomers, ethylene-based rubber, and PEEK. In some embodiments, the dispersed swellable metallic material may be cutings obtained from a machining process.

In some examples, the metal hydroxide formed from the swellable metallic material may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metallic material. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metallic material may allow the swellable metallic material to form additional metal hydroxide and continue to swell.

Examples of Gravel Pack Flow Control Using Swellable Metallic Materials

FIG. 1 is an elevation view of an example well system 10 for gravel packing an inflow control device (ICD) according to aspects of the present disclosure. FIG. 1 includes a non-exhaustive combination of features configured for use with a swellable metallic material. This example combination of features is included for discussion purposes only, recognizing that other embodiments may omit certain features of FIG. 1 and include other features not shown in FIG. 1. Many non-limiting further examples of such features and combinations thereof are further discussed below in the numerous figures that follow FIG. 1. Although the wellbore 22 is depicted in FIG. 1 as being cased, it should be understood that the wellbore could be completed open hole in keeping with the principles of the invention. In addition, although the screen 14 is shown as being positioned in a generally vertical portion of the wellbore 22, such screens may alternatively, or in addition, be positioned in horizontal or otherwise deviated portions of a wellbore.

FIG. 1 illustrates, in part, a gravel packing phase being performed in the well system 10. A gravel slurry 12 is flowed down through a completion string 20 and out through an aperture 24 into a space 18 between a completion string 20 and a wellbore 22. In this manner, a gravel pack 16 may be installed about a screen 14 interconnected in a completion string 20. The gravel slurry 12 includes a solid component comprising a particulate material generally referred to as the gravel, and a liquid carrier, which may be mixed at the surface to form the gravel slurry 12 and delivered downhole through the completion string 20. A gravel pack assembly generally indicated at 15 is shown in partial cross-section to reveal selected layers and features, including the screen 14 on the outside, an optionally-perforated base pipe 30 concentrically disposed interior to the screen 14, and a removeable wash pipe 40 concentrically disposed interior to the perforated base pipe 30. An inflow control device (ICD) 50 is provided at an upper end of the gravel pack assembly 15 to control a flow regime of produced formation fluids such as oil, gas, and water components after the gravel packing is complete.

During gravel packing phase, as the gravel slurry 12 flows about the screen 14, the particulate of the slurry builds up around the screen 14 as illustrated, to pack the space 18 between the completion string 20 and wellbore 22 in the vicinity of the screen 14. Unlike in a conventional ICD base pipe, the base pipe 30 in FIG. 1 is perforated. Instead of slurry fluid being forced to flow around the base pipe 30 during gravel packing, it may flow through the screen 14 and the plurality of perforations 32 along the length of the base pipe 30. This will provide a more uniform hydration of the gravel slurry during the gravel packing process to ensure a uniform, high-quality gravel pack around the screen 14. The slurry fluid initially drains through the screen 14 and the perforations 32 directly into the base pipe 30 and, may be carried away such as through the wash pipe 40. When the gravel packing phase is complete, the distributed particulate of the gravel pack will provide a porous structure through which formation fluids may be flowed to be produced uphole through a production tubing string (not shown).

Prior to production, a plurality of the perforations 32 will be plugged by activating a swellable metallic material with a reactive fluid such as a brine. A plurality of the perforations 32 but not necessarily all of the perforations 32 may have a swellable metallic material as described below. Likewise, as a practical matter a plurality of the perforations 32 but not necessarily all of the perforations will become plugged by the swellable metallic material when activated. During production, fluids will not be able to flow through the perforations 32 that become plugged. Instead, the path of least resistance would then be through the ICD 50. This will allow the ICD to perform its function, which may be to control a flow regime of the produced formation fluids, such as to preferentially produce certain components of the formation fluid like oil while inhibiting the production of other components such as water. A variety of ICDs are generally known in the art apart from the particular teachings and combination of features disclosed herein, and a variety of ICD configurations are thus available for use with the disclosed system 10.

Figure 2:
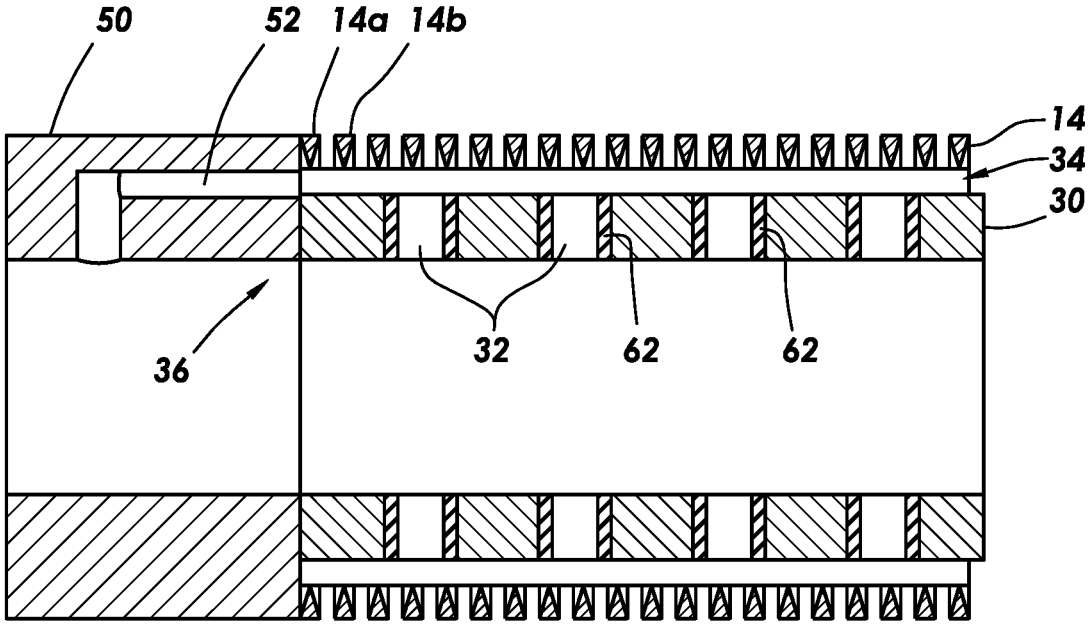
FIG. 2 is a cross-sectional diagram of a gravel pack assembly using a perforated base pipe such as in the embodiment of FIG. 1.
Figure 3:
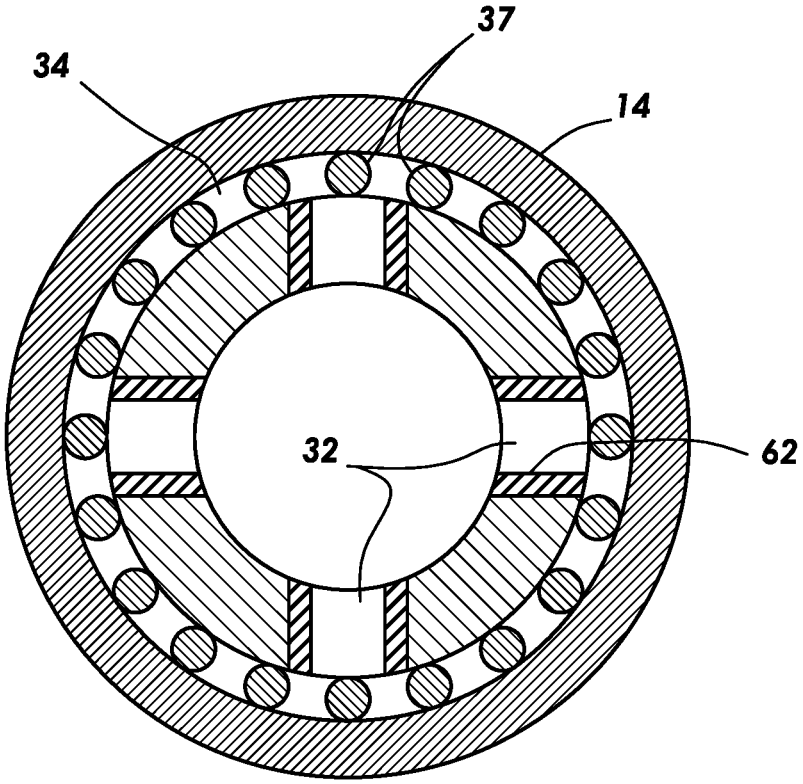
FIG. 3 is a cross-sectional view of the gravel pack assembly of FIG. 2 as taken through a plane perpendicular to a central axis.

FIG. 2 is a cross-sectional diagram (along a central axis) of one example configuration of the gravel pack assembly 15 such as in the perforated base pipe embodiment of FIG. 1. The base pipe 30 has a plurality of radial perforations 32 axially spaced along a length of the base pipe 30. A screen 14 is disposed about the base pipe 30. The screen 14 may be formed, for example, by a plurality of wires, e.g. 14*a*, 14*b* circumferentially wrapped around and axially spaced along the base pipe 30, in combination with a plurality of axially-extending ribs 37 (see FIG. 3) that intersect the wires 14*a*, 14*b* to define screen openings therebetween. An outer annulus 34 is defined between the screen 14 and the base pipe 30. In this example screen, the annulus 34 would comprise axially-extending spaces between the ribs 37 (FIG. 3). During a gravel pack phase, fluid may flow primarily longitudinally along the outer annulus 34 and base pipe 30 and inwardly through the perforations 32 and then along an inner annulus between the base pipe and an interior wash pipe as further discussed below in relation to FIGS. 4 and 5.

The inflow control device (ICD) 50 defines an ICD flow path 52 in fluid communication with the outer annulus 34 at a first end 36 of the base pipe 30. A swellable metallic material 62 is disposed within the perforations 32 of the base pipe 30 to later plug the perforations 32 in response to a reactive fluid to conclude the gravel pack phase. At that point the majority of flow (of formation fluids) may pass through the ICD flow path 52 as further discussed below.

FIG. 3 is a cross-sectional view of the gravel pack assembly 15 of FIG. 2 as taken through a plane perpendicular to a central axis. Components of the gravel pack assembly 15 may be generally circular in cross section and concentrically disposed with respect to one another. In this example, the perforated base pipe 30 is centrally disposed within the screen 14 and may be centralized within the screen 14 by a plurality of axially-extending screen ribs 37 within the outer annulus 34 between the screen 14 and base pipe 30. The axially-extending ribs 37 may be generally arranged in a direction of flow through the outer annulus 34 when fluid is flowed through the screen to the wash pipe (discussed infra) or ICD 50 (FIG. 2). The perforations 32 on the base pipe 30 are radially extending, and in addition to being axial spaced (FIG. 2), may be arranged in a plurality of rows of the perforations 32 that are circumferentially spaced from one another as shown in FIG. 3. The swellable metallic material 62 may form a ring at a periphery of each perforation 32.

Figure 4:
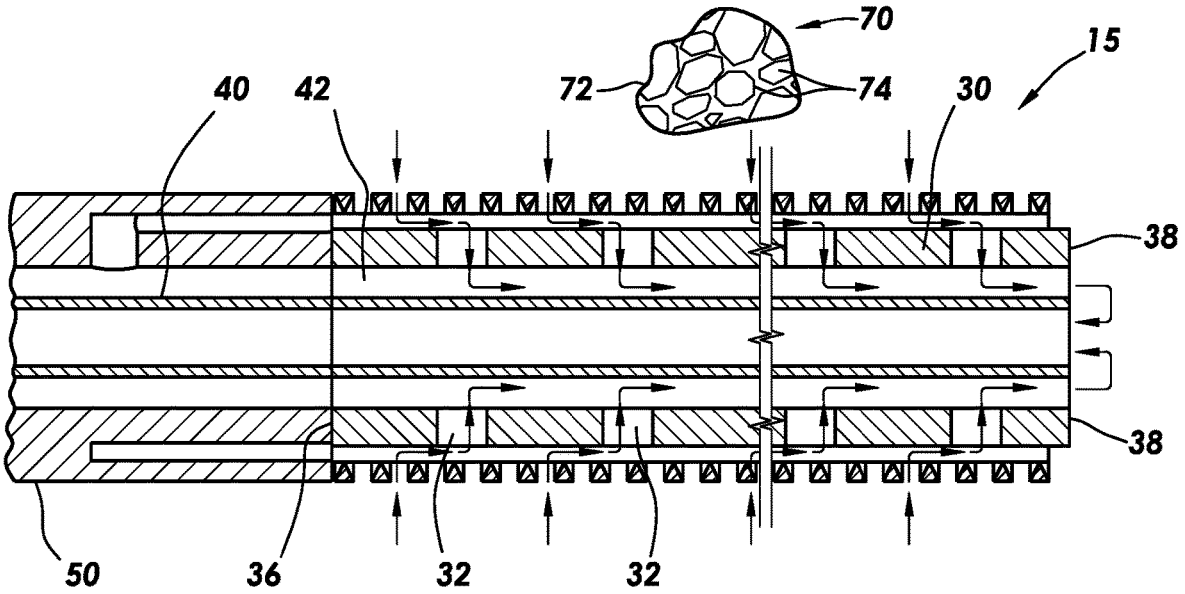
FIG. 4 is another cross-sectional view of the gravel pack assembly of FIGS. 2 and 3 during a gravel pack phase.

FIG. 4 is another cross-sectional view of the gravel pack assembly 15 of FIGS. 2 and 3 during a gravel pack phase. A wash pipe 40 is removably positioned inside the base pipe 30 to define an inner annulus 42 between the wash pipe 40 and the base pipe 30. The wash pipe 40 extends downhole to a second end 38 of the base pipe 30 that is downhole of and opposite the first end 36 where the ICD 50 is located. The wash pipe 40 in this embodiment is thus configured for receiving flow at the end of the base pipe 30 opposite the ICD 50 that has passed through the perforations 32 into the inner annulus 42.

A gravel slurry schematically depicted at 70 comprises a particulate 72 and a slurry fluid 74. Flow arrows are shown to generally indicate portions of a gravel pack (GP) flow path along with the slurry fluid 74 flows through the gravel pack assembly 15 during the gravel pack phase. The gravel slurry 70 may be delivered downhole through a work string (not shown) to an exterior of the gravel pack assembly 15. The wash pipe 40 is typically sealed at an uphole end (to the left, not shown) to prevent flow uphole along the inner annulus 42. The space downhole (to the right) of the wash pipe 40 is also sealed or otherwise closed off. Thus, flow is constrained to move downhole along the screen and inwardly until it enters the lower, open end of the wash pipe as illustrated with flow arrows. As the gravel slurry 70 flows around the gravel pack assembly 15, the flow may be evenly distributed along the exterior of the screen and inwardly through the screen 14 and perforations 32 toward the lower end 38 of the base pipe 30 where the slurry fluid 74 washes into the wash pipe 40 and back toward surface. As the slurry 70 flows in this manner the particulate 72 may be evenly distributed along the screen 14 as the slurry fluid 74 drains out of the slurry, through the screen 14, into the base pipe 30 through perforations 32, along the inner annulus 42, and carried away through the wash pipe 40.

The GP flow path in this embodiment may include the perforations 32 and the inner annulus 42 extending to the wash pipe 40. Although there may be some incidental flow through the ICD 50, the majority of flow may follow path(s) of least resistance, which may be away from the ICD 50 and out through the wash pipe 40. A majority of liquid from the gravel slurry will flow through the perforations 32 and into the inner annulus 42 to the wash pipe 40, rather than along the outer annulus 34 to the ICD 50. The GP flow path defined by the perforations 32 in this embodiment facilitates an evenly distributed flow and resulting gravel pack.

Figure 5:
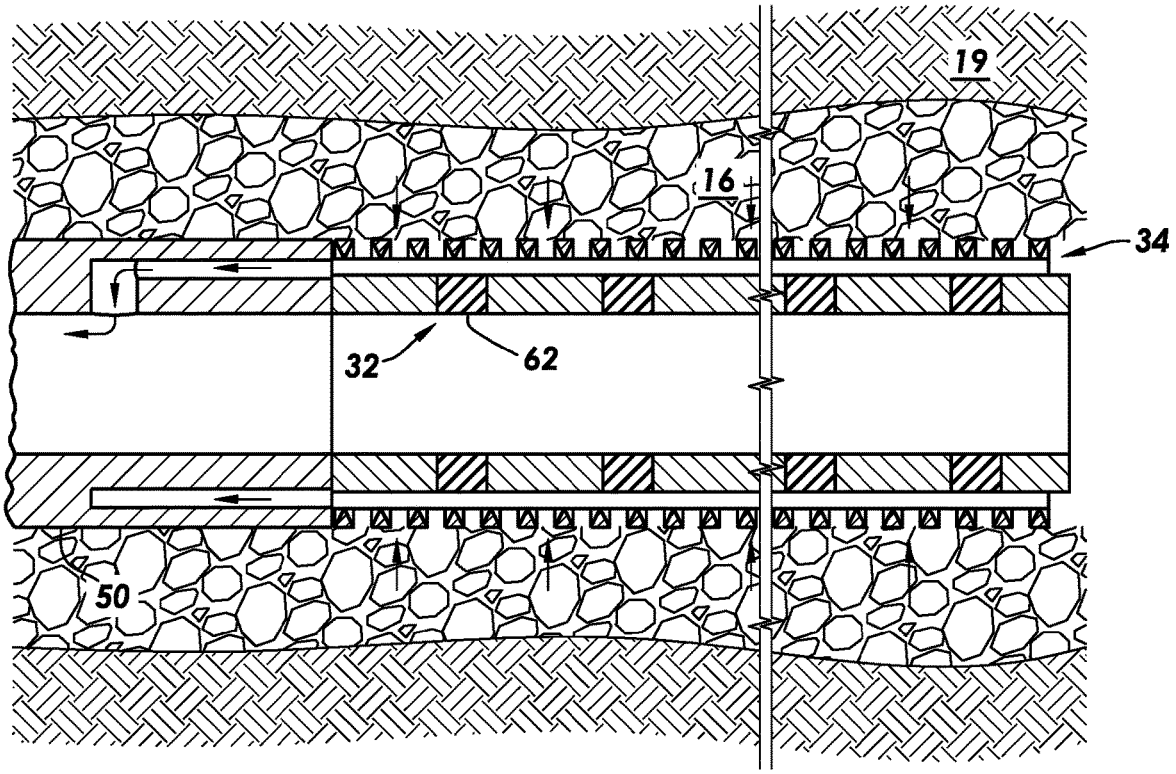
FIG. 5 is another cross-sectional view of the gravel pack assembly of FIG. 4 during a subsequent production phase after the gravel pack 16 has been completed.

FIG. 5 is another cross-sectional view of the gravel pack assembly 15 of FIG. 4 during a subsequent production phase after the gravel pack 16 has been completed. The gravel pack 16 has now been established as shown in the cutaway view between the formation 19 about the screen 14. To plug the perforations 32, a reactive fluid such as a brine may have been flowed through or by the perforations 32 to activate the swellable metallic material 62. For example, the reactive fluid may be included with the gravel slurry of FIG. 4, during or toward the latter end of the gravel pack phase. Alternatively, a reactive fluid may be flowed after the gravel pack phase was complete. As a result, the perforations 32 have now become plugged by the swellable metallic material 62 in FIG. 5.

Flow arrows are shown to generally indicate flow of formation fluids through the gravel pack assembly 15 during a production phase. During production, formation fluids such as oil, gas, water, or combinations thereof flow from the formation 19 in the vicinity of the completion string. Formation fluid may flow radially inwardly through the gravel pack 16 and screen 14 and into the outer annulus 34. Due to the plugged perforations 32, the formation fluids then flow through the outer annulus 34 toward the ICD 50. Substantially all flow along the outer annulus 34 may be constrained to flow to the ICD flow path 52 defined by the ICD 50. The ICD 50 may do what it is provided to do, such as to preferentially produce certain fluid components such as oil over other fluid components such as water within the formation fluid.

Figure 6B:
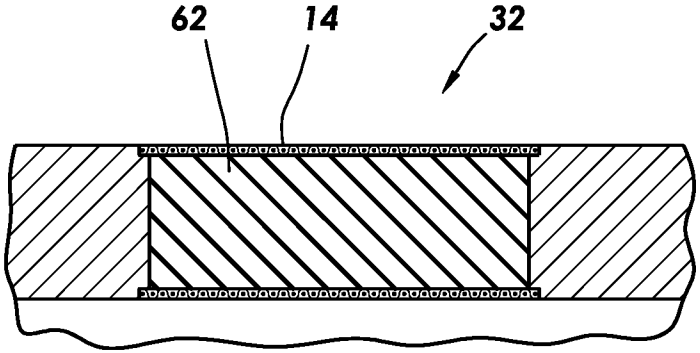
FIG. 6B is a side view of the perforation after the swellable metallic material has been activated to plug the perforation.
Figure 6A:
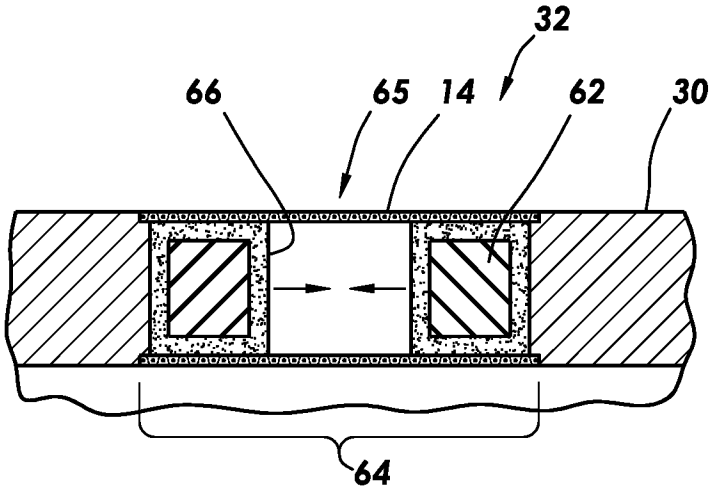
FIG. 6A is a side view of the perforation wherein the swellable metallic material 62 is optionally arranged as a donut-shaped insert.

FIGS. 6A and 6B are side views of a perforation 32 of the base pipe 30 illustrating an example of how the perforations 32 may be plugged via activation of the swellable metallic material 62. FIG. 6A is a side view of the perforation 32 wherein the swellable metallic material 62 is optionally arranged as a donut-shaped insert 64. The donut-shaped insert 64 defines a hole 65 concentric with the perforation 32 through which fluids may pass through the perforation 32. An optional fluid-soluble coating 66 is provided on the swellable metallic material 62 may be provided to dissolve in fluid over time to delay activation of the swellable metallic material 62. It may be desirable to delay reaction, for example, if the reactive fluid (e.g. brine) is contained within the gravel slurry, so that the gravel pack may be completed before the perforations 32 get plugged. Or, it may be desirable to delay reaction to allow the wellbore to return to an elevated temperature conducive to the reaction after the gravel pack phase may have cooled the borehole in the vicinity.

Physical constraints are also provided by the configuration of FIG. 6A to facilitate the activation of the swellable metallic material 62 into a sufficiently hard mass to plug the perforation 32. Those constraints include the ID of the perforation 32, to prevent radially-outward expansion of the swellable metallic material 62. Thus, the swellable metallic material 62 must expand radially inwardly. The screen 14 also provides upper and lower physical constraints so that the swellable metallic material 62 is constrained within a fixed volume defined by the perforation 32 and the screen 14 at both ends. FIG. 6B is a side view of the perforation 32 after the swellable metallic material 62 has been activated to plug the perforation 32.

Figure 7B:
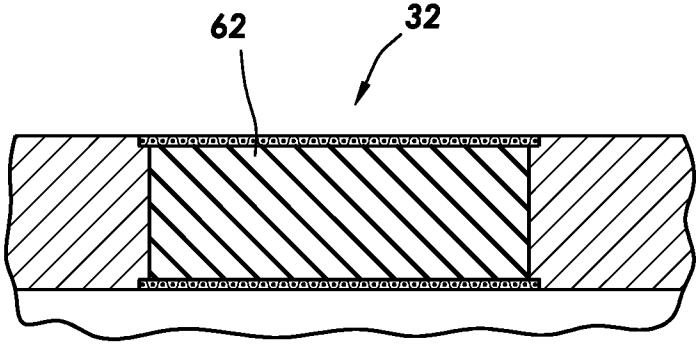
FIG. 7B is a side view of the perforation after swellable metallic material has been activated to plug the perforation.
Figure 7A:
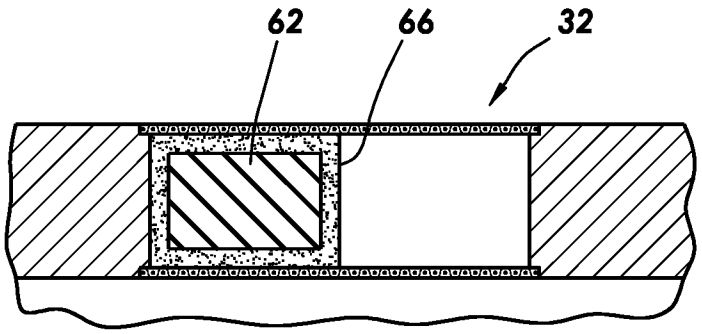
FIG. 7A is a side view of the perforation wherein the swellable metallic material is optionally arranged on one side of the perforation.

FIGS. 7A and 7B are side views of the perforation 32 illustrating another example configuration of the swellable metallic material 62. FIG. 7A is a side view of the perforation 32 wherein the swellable metallic material 62 is optionally arranged on one side of the perforation 32. The swellable metallic material 62 occupies only a portion of the perforation 32 so that slurry fluid may still pass through the perforation 32. The optional fluid-soluble coating 66 is also provided on the swellable metallic material 62, again, to delay activation of the swellable metallic material 62. Physical constraints are also again provided by the configuration of FIG. 7A to facilitate the activation of the swellable metallic material 62 into a sufficiently hard mass to plug the perforation 32. Those constraints again include the ID of the perforation 32, and the screen 14. FIG. 7B is a side view of the perforation 32 after swellable metallic material 62 has been activated to plug the perforation 32.

Figure 8:
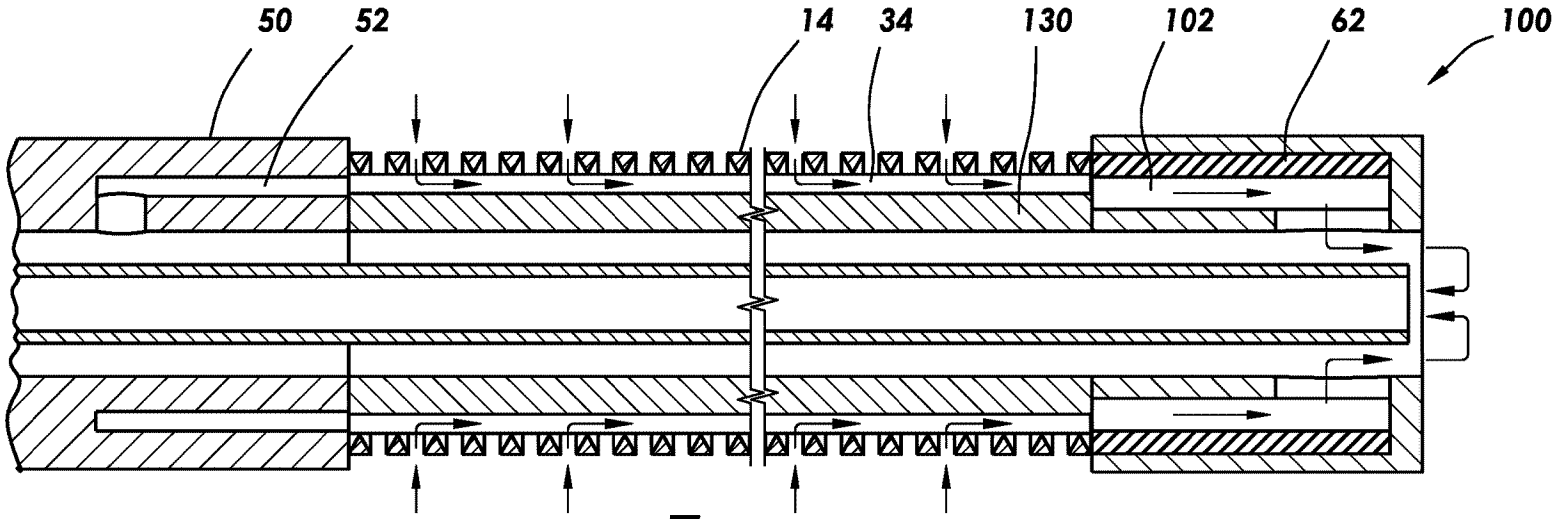
FIG. 8 is a cross-sectional diagram of another example configuration of the gravel pack assembly that uses a non-perforated base pipe.

FIG. 8 is a cross-sectional diagram (along a central axis) of another example configuration of the gravel pack assembly 15 that uses a non-perforated base pipe 130. Instead of having a plurality of radial perforations along the base pipe 130, the gravel pack assembly in FIG. 8 instead uses a secondary flow housing 100 to aid the gravel pack phase. As in the FIG. 2 embodiment, the screen 14 is disposed about the base pipe 130 and defines an outer annulus 34 between the screen 14 and the base pipe 130. The inflow control device (ICD) 50 is also again provided, defining the ICD flow path 52 in fluid communication with the outer annulus 34 at the first end 36 of the base pipe 130. The secondary flow housing 100 in FIG. 8 is positioned at the second end 38 of the base pipe 130 opposite the ICD 50.

The secondary flow housing 100 defines a flow path 102 in fluid communication with the outer annulus 34 at the second end 38 of the non-perforated base pipe 130. The GP flow path in this embodiment includes the flow path 102 through the secondary flow housing 100. The majority of slurry fluid may pass through the flow path 102 during the gravel pack phase, which facilitates flow along the length of the screen 14 to evenly distribute the gravel slurry. The secondary flow housing 100 initially has less flow restriction than the ICD 50. For example, the GP flow path 102 may have a larger total cross-sectional flow area and/or the ICD 50 have internal flow restrictions. As a consequence, the majority of flow into the outer annulus 34 will desirably follow a path of less resistance through the secondary housing 100 instead of through the ICD 50. The swellable metallic material 66 is disposed along the flow path 102 through the secondary housing 100 in this embodiment.

Figure 9:
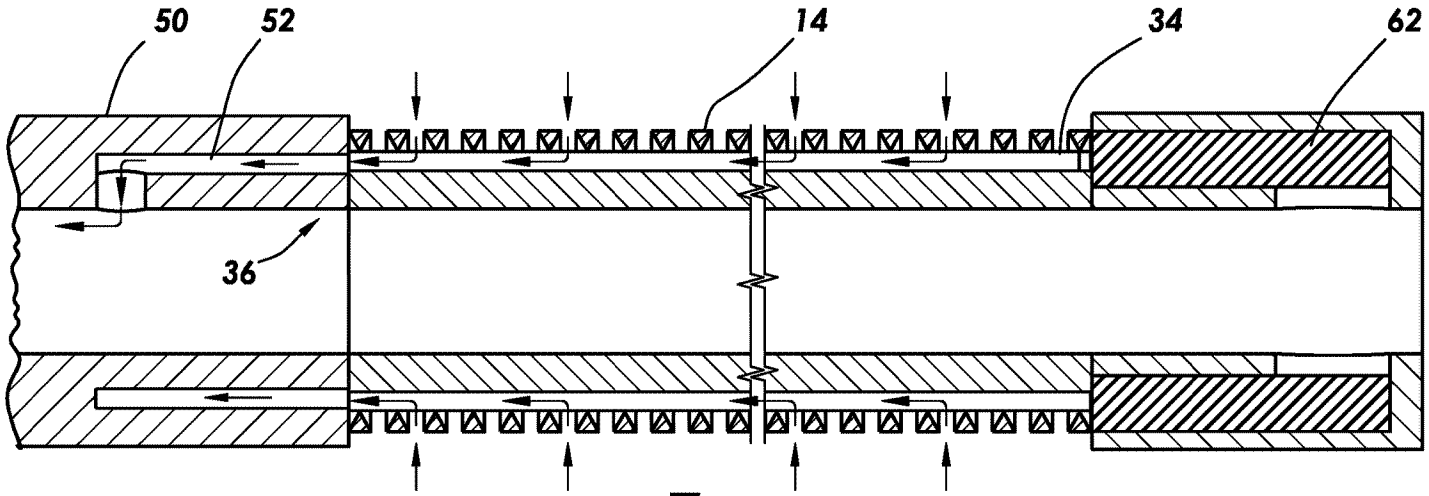
FIG. 9 is another cross-sectional view of the gravel pack assembly of FIG. 8 during a production phase following the gravel pack phase.

FIG. 9 is another cross-sectional view of the gravel pack assembly 15 of FIG. 8 during a production phase following the gravel pack phase. The swellable metallic material 66 has now been activated, such as by a brine, and has expanded to reduce and preferably close flow through the flow path 102. Thus, flow through the flow path 102 of the secondary housing 100 is significantly limited and at least some flow is instead diverted to the ICD 50 and through the ICD flow path 52. Thus, formation fluids passing through the screen 14 may be preferentially produced by the ICD 50.

Figure 10:
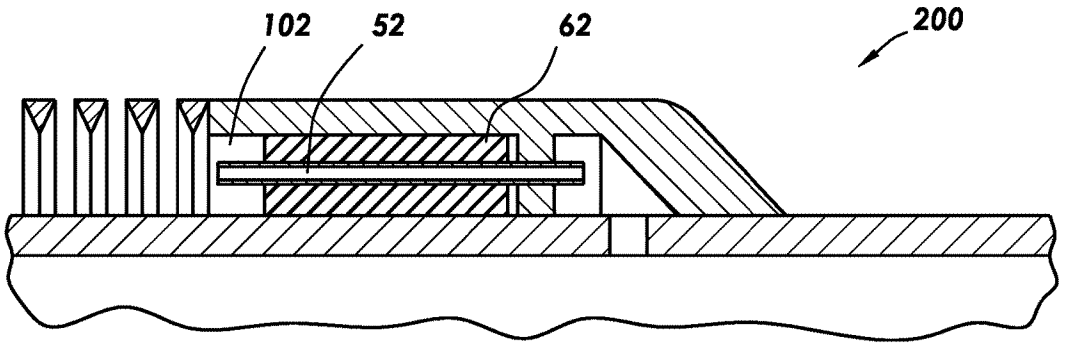
FIG. 10 is cross-sectional view of yet another embodiment, wherein the ICD flow path and GP flow path both pass through the same housing.

FIG. 10 is cross-sectional view of yet another embodiment, wherein the ICD flow path 52 and GP flow path 102 both pass through the same housing, which may be referred to as the shared housing 200 in this embodiment. The flow path 102 was initially open prior to activation of the swellable metallic material 62, so that the slurry fluid may flow through the shared housing 200. In FIG. 10, the flow path 102 has since been closed by activation of the swellable metallic material 62, so that subsequent flow (of formation fluids) is through the ICD flow path 52 in the shared housing 200.

Figure 11B:
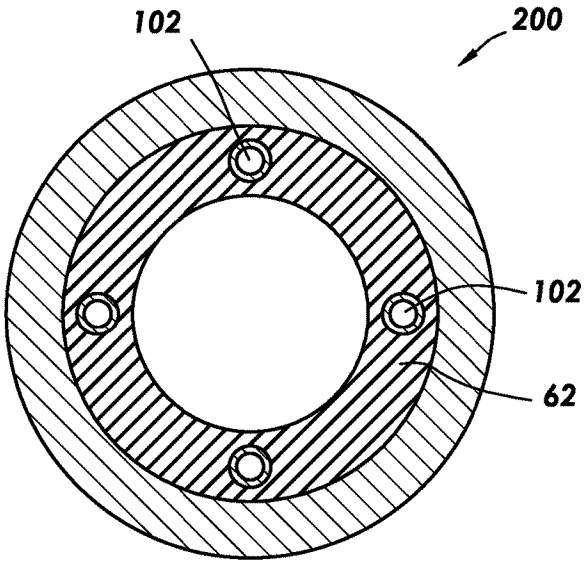
FIG. 11B is another cross-sectional view of the embodiment of FIG. 11A, after the swellable metallic material has been activated to close off flow through the cavities in the ring of swellable material.
Figure 11A:
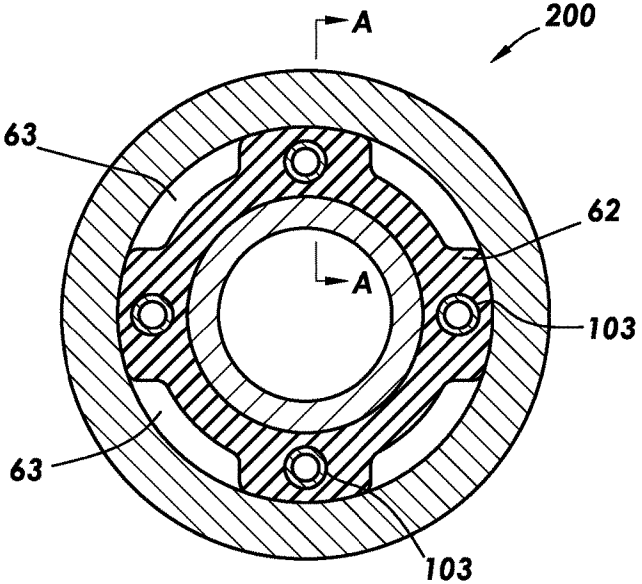
FIG. 11A is a cross-sectional view of the embodiment of FIG. 10 according to an example configuration prior to activation of the swellable metallic material.

FIG. 11A is a cross-sectional view of the embodiment of FIG. 10 along a plane through the central axis, according to an example configuration prior to activation of the swellable metallic material 66. One or more conduit 103 (this example shows four conduits 103) defines the ICD flow path through the housing 200. The conduit 103 is disposed in a mass of the swellable metallic material 62, arranged in a ring. The swellable metallic material 62 defines one or more cavities 63 that define the GP flow path in parallel with the conduits 102 that define the ICD flow path. When activated, the swellable metallic material will expand to close the cavities 63.

FIG. 11B is another cross-sectional view of the embodiment of FIG. 11A, after the swellable metallic material 62 has been activated to close off flow through the cavities 63 of FIG. 11A. Thus, the GP flow path has now been closed, and all flow through the secondary housing 200 is constrained to flow through the ICD flow paths 102.

To facilitate a better understanding of the present invention, the following examples of certain aspects of some embodiments are given. In no way should the following examples be read to limit, or define, the entire scope of the disclosure.

Example 1. An apparatus comprising: a base pipe having a plurality of radial perforations axially spaced along a length of the base pipe; a screen disposed about the base pipe and defining an outer annulus between the screen and the base pipe; an inflow control device (ICD) having an ICD flow path in fluid communication with the outer annulus at a first end of the base pipe; and a swellable metallic material within the perforations of the base pipe and configured to plug the perforations in response to a reactive fluid.

Example 2. The apparatus of Example 1, further comprising: a wash pipe removably positioned inside the base pipe to define an inner annulus between the wash pipe and the base pipe extending to an end of the base pipe opposite the ICD, the wash pipe configured for receiving flow at the end of the base pipe opposite the ICD that has passed through the perforations into the inner annulus.

Example 3. The apparatus of any of the foregoing Examples, wherein flow along the outer annulus is constrained to flow to the ICD in response to the perforations on the base pipe being plugged.

Example 4. The apparatus of any of the foregoing Examples, wherein the ICD is configured for preferentially producing one or more fluid components of a multi-component formation fluid flowing through the ICD.

Example 5. The apparatus of any of the foregoing Examples, further comprising: a plurality of axially-extending ribs circumferentially spaced along the outer annulus.

Example 6. The apparatus of any of the foregoing Examples, wherein the swellable metallic material is arranged as a donut-shaped insert within each of one or more perforations, each donut-shaped insert comprising a hole through which fluids may pass.

Example 7. The apparatus of any of the foregoing Examples, further comprising: a fluid-soluble coating on the swellable metallic material configured to dissolve in fluid over time to delay activation of the swellable metallic material.

Example 8. An apparatus, comprising: a non-perforated base pipe; a screen disposed about the base pipe and defining an outer annulus between the screen and the base pipe; an inflow control device (ICD) having an ICD flow path in fluid communication with the outer annulus; a secondary flow housing having a gravel pack (GP) flow path in fluid communication with the outer annulus; and a metallic material configured to close flow through the GP flow path in response to a reactive fluid over time.

Example 9. The apparatus of Example 8, further comprising: a wash pipe removably positioned inside the base pipe defining an inner annulus between the wash pipe and the base pipe extending toward a second end of the base pipe opposite the ICD;

Example 10. The apparatus of Examples 8 or 9, further comprising: the ICD is positioned at a first end of the base pipe; and the secondary flow housing is positioned at a second end of the base pipe opposite the first end.

Example 11. The apparatus of Example 8, further comprising: the ICD flow path and GP flow path are both within the secondary flow housing.

Example 12. The apparatus of Example 11, further comprising: an ICD flow path in parallel with a GP flow path within the secondary flow housing, wherein at least some of the swellable metallic material is disposed adjacent to the GP flow path to close the GP flow path upon swelling.

Example 13. The apparatus of Example 12, further comprising a conduit defining the ICD flow path, the conduit disposed in a mass of the swellable metallic material, the swellable metallic material defining one or more cavities that define the GP flow path in parallel with the ICD flow path.

Example 14. The apparatus of Example 12, wherein the mass of swellable metallic material is arranged in a ring, with a plurality of the conduit are circumferentially arranged along the ring, and a plurality of the cavities are circumferentially arranged along the ring.

Example 15. An apparatus comprising: a base pipe; a screen disposed about the base pipe and defining an outer annulus between the screen and the base pipe; an inflow control device (ICD) having an ICD flow path in fluid communication with the outer annulus at a first end of the base pipe;

a gravel pack (GP) flow path in fluid communication with the outer annulus configured to divert at least some flow in the outer annulus away from the ICD; and a metallic material configured to close the GP flow path in response to a reactive fluid.

Example 16. The apparatus of Example 15, wherein the GP flow path comprises a plurality of radial perforations axially spaced along a length of the base pipe, and the metallic material is disposed within the perforations.

Example 17. The apparatus of Example 15, further comprising: a secondary flow housing having an inlet in fluid communication with the outer annulus, wherein the GP flow path passes through the secondary flow housing.

Example 18. The apparatus of Example 17, wherein the ICD flow path also passes through the secondary flow housing.

Example 19. A method comprising: flowing a gravel slurry comprising a particulate carried in a slurry fluid into a space to be gravel packed; draining the slurry fluid through a screen disposed about a base pipe and into an outer annulus between the screen and the base pipe; flowing the drained slurry fluid away from the outer annulus to a gravel pack (GP) flow path; and closing the GP flow path by reacting a metallic material in response to a reactive fluid.

Example 20. The method of Example 19, further comprising: after closing the GP flow path, flowing a formation fluid through the screen and the outer annulus to the ICD.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus comprising:

a base pipe having a plurality of radial perforations axially spaced along a length of the base pipe;

a screen disposed about the base pipe and defining an outer annulus between the screen and the base pipe;

an inflow control device (ICD) having an ICD flow path in fluid communication with the outer annulus at a first end of the base pipe; and a swellable metallic material within the radial perforations of the base pipe and configured to plug the perforations in response to a reactive fluid.

2. The apparatus of claim 1, further comprising:

a wash pipe removably positioned inside the base pipe to define an inner annulus between the wash pipe and the base pipe extending to an end of the base pipe opposite the ICD, the wash pipe configured for receiving flow at the end of the base pipe opposite the ICD that has passed through the perforations into the inner annulus.

3. The apparatus of claim 1, wherein flow along the outer annulus is constrained to flow to the ICD in response to the perforations on the base pipe being plugged.

4. The apparatus of claim 1, wherein the ICD is configured for preferentially producing one or more fluid components of a multi-component formation fluid flowing through the ICD.

5. The apparatus of claim 1, further comprising:

a plurality of axially-extending ribs circumferentially spaced along the outer annulus.

6. The apparatus of claim 1, wherein the swellable metallic material is arranged as a donut-shaped insert within one or more of the perforations, each donut-shaped insert comprising a hole through which fluids may pass.

7. The apparatus of claim 1, further comprising:

a fluid-soluble coating on the swellable metallic material configured to dissolve in fluid over time to delay activation of the swellable metallic material.

8. An apparatus, comprising:

a non-perforated base pipe;

a screen disposed about the base pipe and defining an outer annulus between the screen and the base pipe;

an inflow control device (ICD) having an ICD flow path in fluid communication with the outer annulus;

a secondary flow housing having a gravel pack (GP) flow path in fluid communication with the outer annulus; and a swellable metallic material configured to swell irreversibly by the formation of a metal hydroxide to limit flow through the GP flow path in response to a reactive fluid over time.

9. The apparatus of claim 8, further comprising:

a wash pipe removably positioned inside the base pipe defining an inner annulus between the wash pipe and the base pipe extending toward a second end of the base pipe opposite the ICD.

10. The apparatus of claim 8, further comprising:

the ICD is positioned at a first end of the base pipe; and the secondary flow housing is positioned at a second end of the base pipe opposite the first end.

11. The apparatus of claim 8, further comprising:

the ICD flow path and GP flow path are both within the secondary flow housing.

12. The apparatus of claim 11, further comprising:

an ICD flow path in parallel with a GP flow path within the secondary flow housing, wherein at least some of the swellable metallic material is disposed adjacent to the GP flow path to close the GP flow path upon swelling.

13. The apparatus of claim 12, further comprising a conduit defining the ICD flow path, the conduit disposed in a mass of the swellable metallic material, the swellable metallic material defining one or more cavities that define the GP flow path in parallel with the ICD flow path.

14. The apparatus of claim 12, wherein the swellable metallic material is arranged in a ring, wherein the conduit comprises a plurality of conduits circumferentially arranged along the ring, and the cavities are circumferentially arranged along the ring.

15. An apparatus comprising:

a base pipe;

a screen disposed about the base pipe and defining an outer annulus between the screen and the base pipe;

an inflow control device (ICD) having an ICD flow path in fluid communication with the outer annulus at a first end of the base pipe;

a gravel pack (GP) flow path in fluid communication with the outer annulus configured to divert at least some flow in the outer annulus away from the ICD; and a metallic material configured to swell irreversibly by the formation of a metal hydroxide to close the GP flow path in response to a reactive fluid.

16. The apparatus of claim 15, wherein the GP flow path comprises a plurality of radial perforations axially spaced along a length of the base pipe, and the metallic material is disposed within the perforations.

17. The apparatus of claim 15, further comprising:

a secondary flow housing having an inlet in fluid communication with the outer annulus, wherein the GP flow path passes through the secondary flow housing.

18. The apparatus of claim 17, wherein the ICD flow path also passes through the secondary flow housing.

19. A method comprising:

flowing a gravel slurry comprising a particulate carried in a slurry fluid into a space to be gravel packed;

draining the slurry fluid through a screen disposed about a base pipe and into an outer annulus between the screen and the base pipe;

flowing the drained slurry fluid away from the outer annulus to a gravel pack (GP) flow path; and closing the GP flow path by reacting a swellable metallic material to irreversibly swell by the formation of a metal hydroxide in response to a reactive fluid.

20. The method of claim 19, further comprising:

after closing the GP flow path, flowing a formation fluid through the screen and the outer annulus to an ICD.

* * * * *